US006585435B2

(12) United States Patent
Fang

(10) Patent No.: US 6,585,435 B2
(45) Date of Patent: Jul. 1, 2003

(54) MEMBRANE KEYBOARD

(76) Inventor: Jason Fang, 11F, No. 56, Mai-Chin Rd., Keelung (TW)

( * ) Notice: Subject to any disclaimer, the term of this patent is extended or adjusted under 35 U.S.C. 154(b) by 0 days.

(21) Appl. No.: 09/945,646

(22) Filed: Sep. 5, 2001

(65) Prior Publication Data

US 2003/0044216 A1 Mar. 6, 2003

(51) Int. Cl.[7] ..... B41J 5/08

(52) U.S. Cl. ..... 400/479; 400/491; 341/22; 345/168; 361/680

(58) Field of Search ..... 400/479, 479.2, 400/479.1, 491, 491.1; 341/22; 361/680; 345/168, 169

(56) References Cited

U.S. PATENT DOCUMENTS 5,220,521 A * 6/1993 Kikinis ..... 708/138
5,595,449 A * 1/1997 Vitkin ..... 400/472
5,742,241 A * 4/1998 Crowley et al. ..... 341/22
5,748,114 A * 5/1998 Koehn ..... 341/22
6,178,619 B1 * 1/2001 Tai ..... 29/622
6,265,993 B1 * 7/2001 Johnson ..... 341/22
6,313,762 B1 * 11/2001 Crowley et al. ..... 341/22
6,356,451 B1 * 3/2002 Nakagawa et al. ..... 361/760

* cited by examiner

*Primary Examiner*—Andrew H. Hirshfeld
*Assistant Examiner*—Dave A. Ghatt
(74) *Attorney, Agent, or Firm*—Birch, Stewart, Kolasch & Birch, LLP

(57) ABSTRACT

An improved membrane keyboard includes a bottom layer, a second conductive membrane layer located above the bottom layer having an output section extended from one end thereof at a selected location linking to an interrupt device, an insulation layer located above the second conductive membrane layer, a first conductive membrane layer located above the insulation layer, a top layer located above the first conductive membrane layer having a jutting section formed at one end with the top layer bonding to the bottom layer and forming an opening end at the jutting section, and a button key layer located between the first conductive membrane layer and the top layer.

5 Claims, 5 Drawing Sheets

MEMBRANE KEYBOARD

FIELD OF THE INVENTION

This invention relates to an improved membrane keyboard and particularly a compact membrane keyboard that allows folding and winding in a roll to facilitate carrying and has a detachable button key layer.

BACKGROUND OF THE INVENTION

Nowadays slim size and light weight have become a prevailing trend in the design and development of technology products. However many personal electronic products now available on the market still have the problem of too large size and are not convenient to carry. For instance, the commonly used keyboards such as those used on general computers or notebook computers, usually include an upper casing, a lower casing, a circuit board located between the upper and lower casing, rubber button keys and key tops. After assembly, the keyboards become very bulky and heavy, and are not foldable. Thus they are difficult to carry and use with personal mobile communication products. It becomes a severe constraint on product application scope and area. This also hinders the innovation and development of personal mobile communication products and impairs their economic effectiveness.

Some producers tried to develop portable keyboards that may be folded to multiple sections to facilitate carrying. They usually have a plurality of connection sections defined on a base board mapping against the button keys configuration and intervals. The circuit boards and button keys are made of pliable materials and are mounted on the connection sections. Below the base board, a substrate made of a pliable material is provided. The periphery of the substrate is divided by selected cutting lines and bordered by a jagged and interlocking protection frame. The keyboard thus made may be folded to a smaller size. However it still has a relatively big thickness after folding and is not convenient for people to carry in a bag. Furthermore, when the keyboard is unfolded for use, the bottom and periphery of the keyboard do not have support means at the folding junctures. Hence the keyboard might get loose and moving at the folding junctures when in use, and result in different elevations on different sections. It makes user's fingers difficult to move around the keyboard during operation. Moreover, the numeral and notation marks embossed on the keyboard tend to wear off after using a period of time.

Then some other producers have developed a soft encasing body to wrap the character and special button keys and circuit board inside to allow the keyboard winding in a roll when not in use. Whereas, those type of keyboards still have the key tops exposed outside the encasing body and result in the wound roll having too large a diameter and make carrying difficult. Furthermore, when using in different countries, the special character button keys have to be changed. It causes inconvenience in production.

SUMMARY OF THE INVENTION

The primary object of the invention is to resolve aforesaid disadvantages. The invention provides a membrane keyboard that is foldable and may be wound in a roll to become a compact size to facilitate carrying and has a detachable button key layer to facilitate change and replacement.

Another object of this invention is to provide an interrupt device for stopping signal output from the keyboard so that the keyboard may be used as part of the table top for holding documents and data without the need of moving the keyboard away, and without taking additional useful table top space.

A further object of this invention is to provide durable numeral and notation marks on the button keys that can withstand depressive operation under external force for a long period of time without wearing or loosening off.

To attain the foregoing objects, the membrane keyboard according to the invention includes a bottom layer, a second conductive membrane layer located above the bottom layer that has an output section formed at a selected location of one end linking to an interrupt device, an insulation layer located above the second conductive membrane layer, a first conductive membrane layer located above the insulation layer, a top layer located above the first conductive membrane layer to bond to the bottom layer and having a jutting section to form an opening end, and a button key layer located between the first conductive membrane layer and the top layer.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
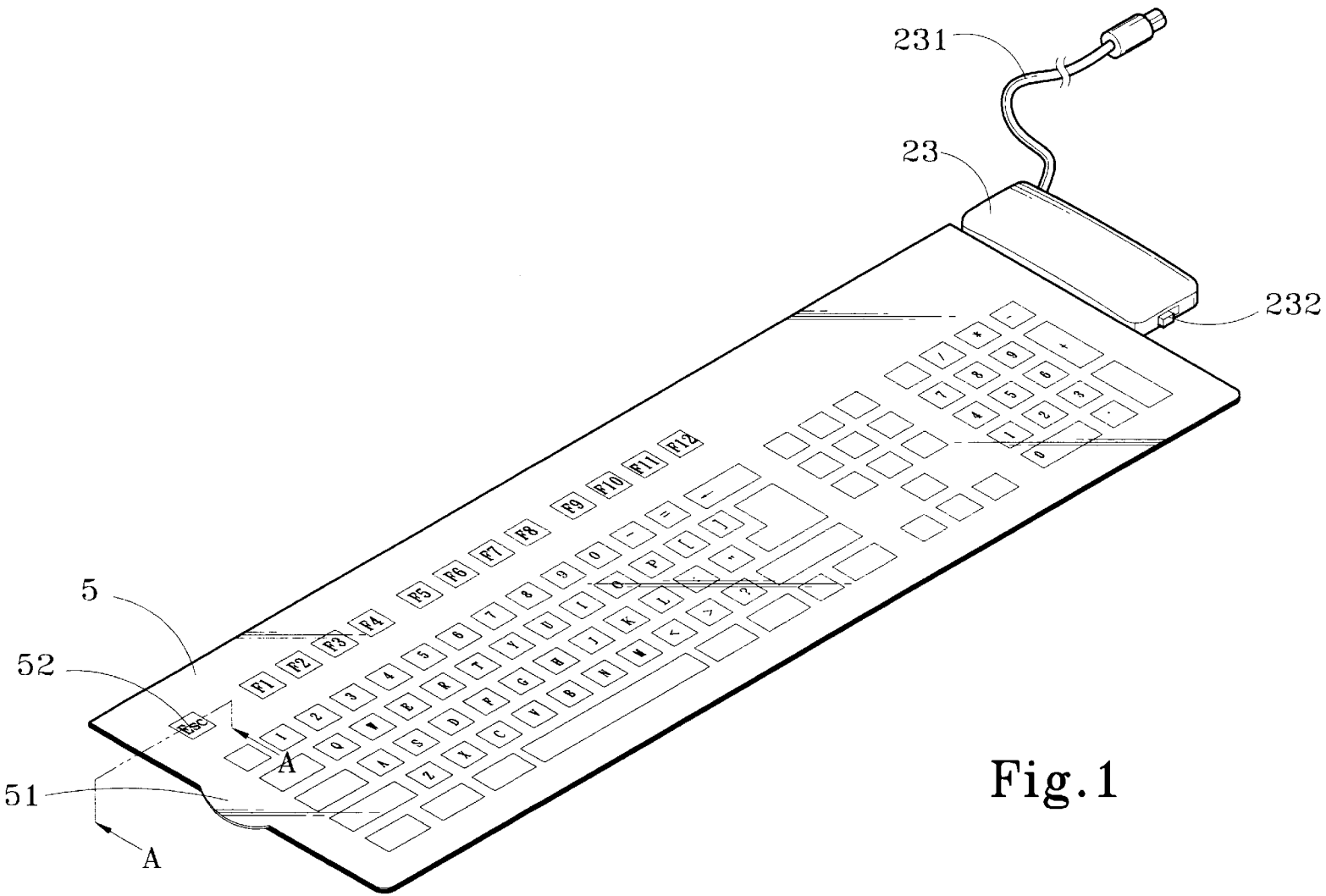
FIG. 1 is a perspective view of the invention.
Figure 2:
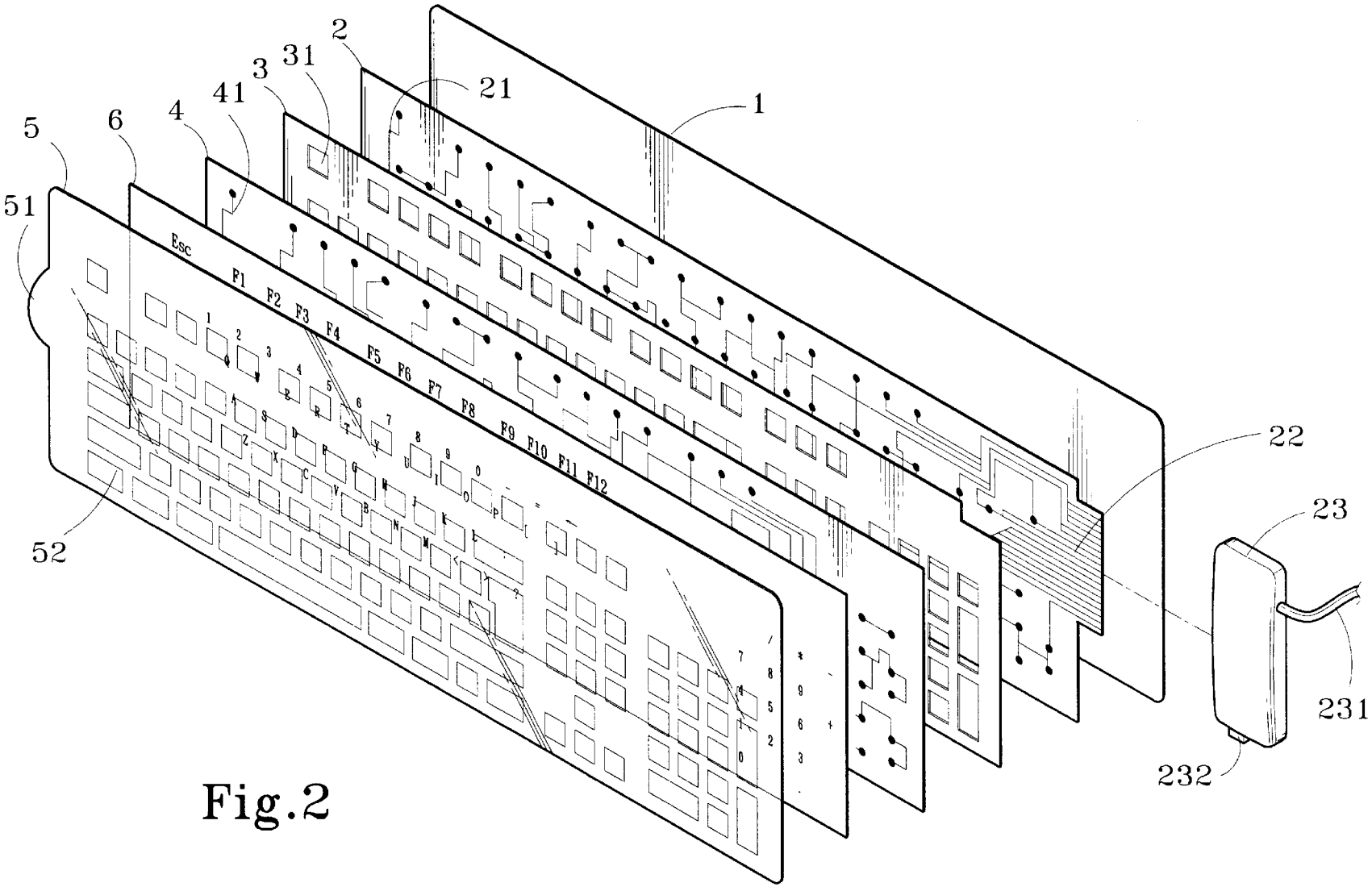
FIG. 2 is an exploded view of the invention.

Referring to FIGS. 1 and 2, the membrane keyboard according to the invention includes a bottom layer 1, a second conductive membrane layer 2, an insulation layer 3, a first conductive membrane layer 4, a top layer 5, and a button key layer 6 to form a compact size that may be wound to a roll to facilitate carrying and with the button key layer 6 detachable easily.

The bottom layer 1 is made of a soft material such as soft foam material, soft plastics, leather, etc. The second conductive membrane layer 2 is located above the bottom layer and has a second conductive circuit 21 formed thereon, and an output section 22 extended from one end at a selected location to link an interrupt device 23 for outputting interrupt commands and connecting a transmission line 231 to link a computer processor (not shown in the drawings).

The insulation layer 3 is located above the second conductive membrane layer 2 and has a plurality of through openings 31 formed thereon.

The first conductive membrane layer 4 is located above the insulation layer 3 and has a first conductive circuit 41 formed thereon.

The top layer 5 is located above the first conductive membrane layer 4 and has a jutting section 51. The top layer 5 is bonded to the bottom layer 1 and forms an opening end 53 at the jutting section 51. The top layer 5 is made of a transparent and soft plastics with traces of a keyboard frame 52 embossed thereon. The keyboard frame 52 may be formed in an irregular shape.

Figure 3:
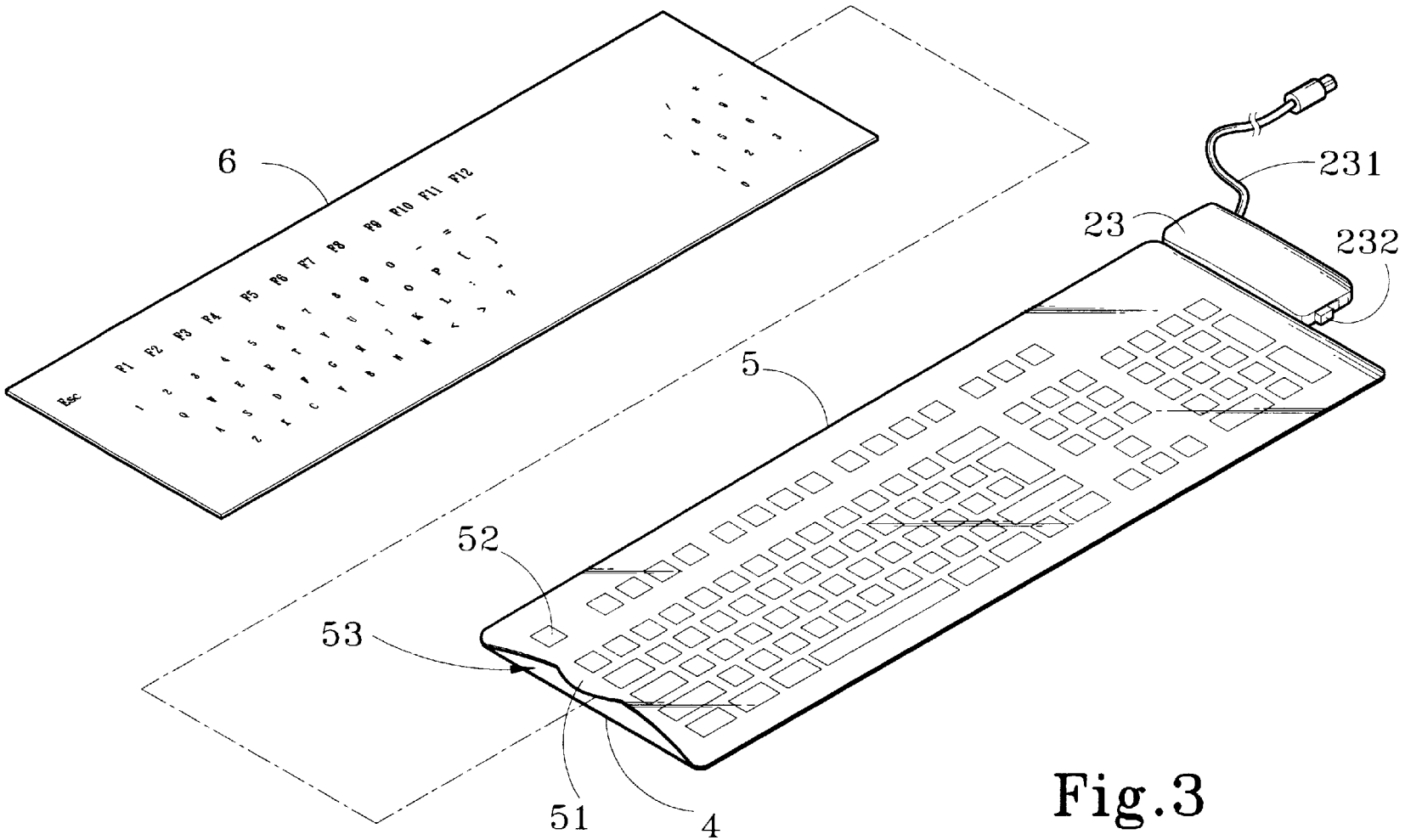
FIG. 3 is a schematic view of the invention for assembly.

The button key layer 6 is sandwiched between the first conductive membrane layer 4 and the top layer 5, and has flat button key clusters (of indicia) for entering input commands (i.e., numerals or notations as clearly shown in FIGS. 2 and 3).

The keyboard thus constructed has the opening end 53 located at one side between the top layer 5 and the first conductive membrane layer 4, thus the button key layer 6 is easy to remove for replacement. The button key clusters on the button key layer 6 won't be loosened after long time of depressive operation under external force. The keyboard is light weight and may be wound in a roll to become a compact size to facilitate carrying.

Referring to FIG. 3, when to assemble the keyboard of the invention, pry the opening end 53 at the jutting section 51 to move the top layer 5 to form an opening slot against the bottom layer 1, then insert the button key layer 6 through the opening end 53 into the keyboard between the first conductive membrane layer 4 and the top layer 5 to match the flat button key clusters of the button key layer 6 with the keyboard frame 52 of the top layer 5 to complete the assembly. Replacement also may be done easily and quickly by pulling out the button key layer 6.

Figure 4A:
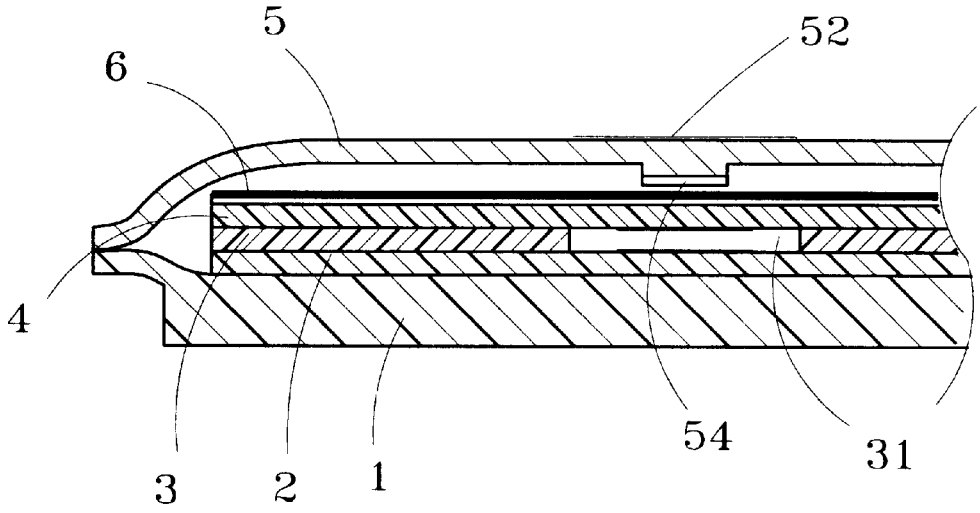
FIG. 4A is a cross section of the invention taken along line 4A—4A in FIG. 1.
Figure 4B:
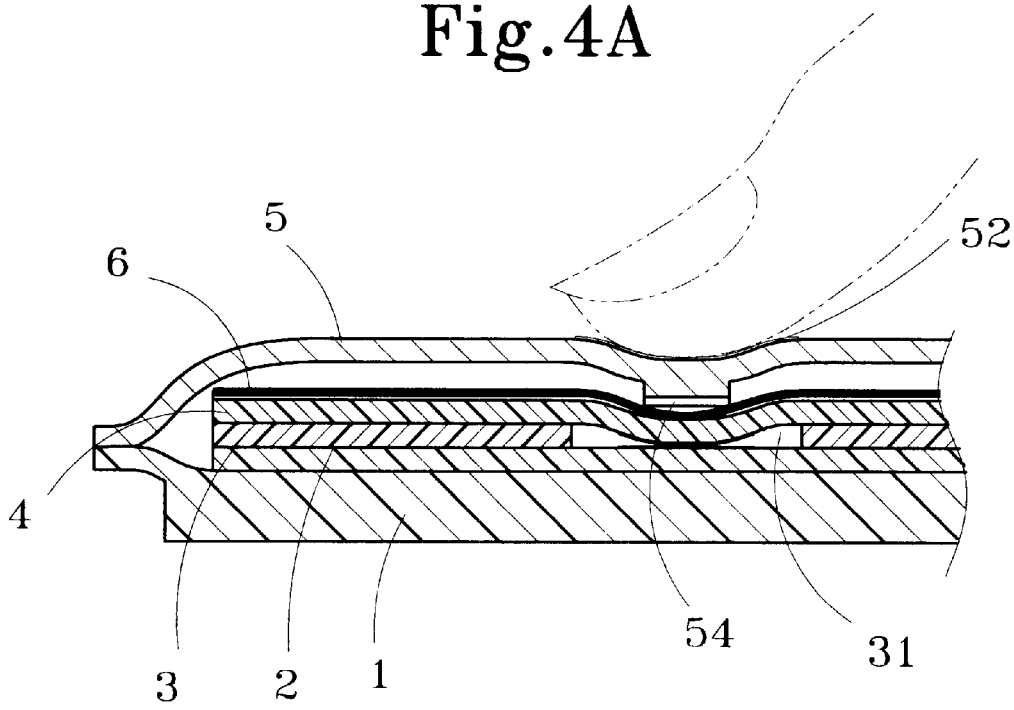
FIG. 4B is a schematic view of the invention under operation, according to FIG. 4A.

Referring to FIGS. 4A and 4B, during keyboard operation, select input commands needed (numerals or notations) on the button key layer 6, and depress the keyboard frame 52 on the top layer 5. When the keyboard frame 52 subjects to an external force, the jutting stub 54 under the top layer 5 will be moved downwards to depress the first conductive membrane layer 4, consequently the first conductive circuit 41 of the first conductive membrane layer 4 will be moved downwards to pass through the opening 31 and contact the second conductive circuit 21 of the first conductive membrane layer 2 to output a command signal, and through the interrupt device 23 transmit to the computer processor.

When users depress the button 232 of the interrupt device 23, signal output from the keyboard will be stopped. Then users may place documents and data directly on the keyboard as if it is part of the table top without the need of moving the keyboard away. Hence table top space may be fully utilized without the concerns of intrusion or obstruction from the presence of the keyboard.

When users want to use the keyboard again, depress the button 232 of the interrupt device 23 again, the keyboard signals will be transmitted to the computer processor. The transmission line 231 linking the interrupt device 23 to the computer may be omitted and replaced by a wireless transmission circuit in the interrupt device 23. Then output signals from the keyboard may be transmitted to the computer processor in a wireless fashion.

Figure 5:
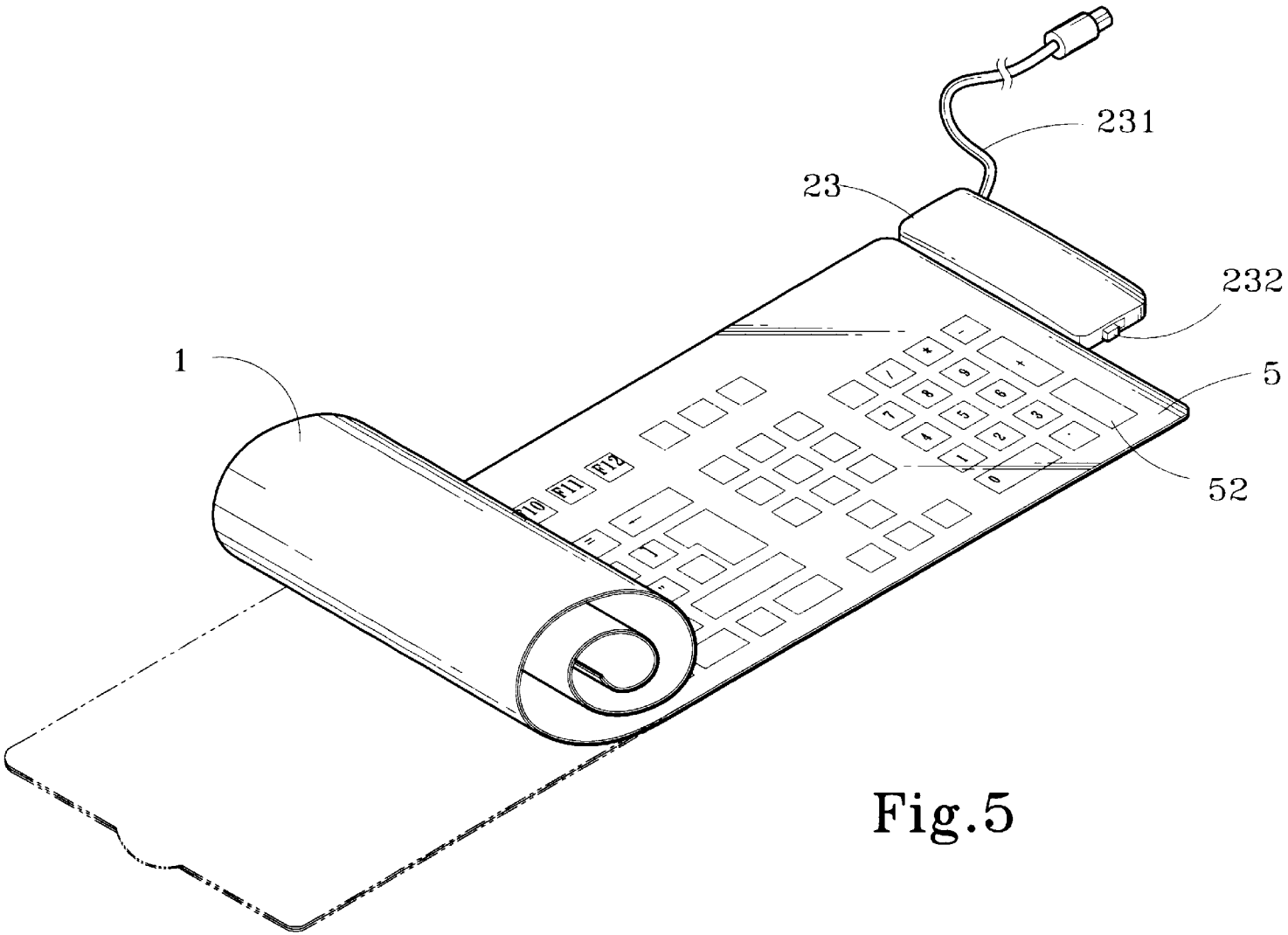
FIG. 5 is a schematic view of the invention for winding to a roll.

Referring to FIG. 5, as the top layer 5 and bottom layer 1 are made of soft material such as foam material, soft plastics, leather, etc., and the first and the second conductive membrane layer 4, 2 and the insulation layer 3 are made of soft membranes, the keyboard may be wound in a roll when not in use to facilitate carrying.

What is claimed is:

1. An improved membrane keyboard, comprising:

a bottom layer;

a first conductive membrane layer having a first conductive circuit formed thereon;

a second conductive membrane layer located above the bottom layer and having a second conductive circuit formed thereon and an output section extended from one end thereof at a selected location linked to an interrupt device configured for outputting interrupt commands;

an insulation layer located above the second conductive membrane layer having a plurality of through openings formed therein;

the first conductive membrane layer is located above the insulation layer;

a top layer located above the first conductive membrane layer, said top layer having a plurality of jutting stubs located thereunder and a jutting section extended from one end thereof, the top layer being bonded to the bottom layer and forming an opening end at the jutting section;

a button key layer located between the first conductive membrane layer and the top layer, said top layer having flat button key clusters corresponding to the jutting stubs of the top layer configured for entering input commands; and wherein the membrane keyboard is light weight and is allowed to wind in a roll to become a compact size for carrying, the button key layer being insertable through the opening end between the top layer and the first conductive membrane layer, and the button key clusters on the button key layer being durable for depressive operation under an external force for a long period of time without loosening.

2. The improved membrane keyboard according to claim 1, wherein the bottom layer comprises a soft material selected from the group consisting of a soft foam material, a soft plastic and leather.

3. The improved membrane keyboard according to claim 2, wherein the top layer is made of a soft and transparent plastic and has traces of an irregular keyboard frame embossed thereon.

4. The improved membrane keyboard according to claim 1, wherein the interrupt device connects a transmission line to link a computer processor.

5. The improved membrane keyboard according to claim 4, wherein the interrupt device includes a wireless transmission circuit for the keyboard to transmit output signals to the computer processor in a wireless transmission fashion.

* * * * *